United States Patent [19]

Smith, Jr.

[11] Patent Number: 4,655,290

[45] Date of Patent: Apr. 7, 1987

[54] LATCHING PRODUCTION SEAL ASSEMBLY

[75] Inventor: Sidney K. Smith, Jr., Huntsville, Tex.

[73] Assignee: Hughes Tool Company, Houston, Tex.

[21] Appl. No.: 809,356

[22] Filed: Dec. 16, 1985

[51] Int. Cl.[4] ..... E21B 23/02

[52] U.S. Cl. ..... 166/382; 166/387; 166/217

[58] Field of Search ..... 166/387, 386, 382, 118, 166/123, 217, 237

[56] References Cited

U.S. PATENT DOCUMENTS

| | | | |
|---|---|---|---|
| 3,842,912 | 10/1974 | Lindsey, Jr. | 166/307 |
| 3,920,075 | 11/1985 | Braddick et al. | 166/290 |
| 3,990,510 | 11/1976 | Decuir | 166/128 |
| 4,248,300 | 2/1981 | Braddick | 166/217 |
| 4,281,711 | 8/1981 | Braddick et al. | 166/118 |
| 4,399,873 | 8/1983 | Lindsey, Jr. | 166/217 |
| 4,406,324 | 9/1983 | Baugh et al. | 166/125 |
| 4,411,455 | 10/1983 | Schnatzmeyer | 166/237 |
| 4,479,548 | 10/1984 | Gilbert | 285/39 |
| 4,482,014 | 11/1981 | Allwin | 166/136 |
| 4,497,371 | 2/1985 | Lindsey, Jr. | 166/208 |

*Primary Examiner*—James A. Leppink
*Assistant Examiner*—Terry Lee Melius
*Attorney, Agent, or Firm*—Charles D. Gunter, Jr.

[57] ABSTRACT

A retrievable production seal assembly is shown for engaging and sealing within the internal bore of the liner within a well. A special latch mechanism carried on the seal assembly includes an externally threaded latch collet which can be stabbed into the setting sleeve threads which are normally provided in the interior of the liner for use with the running tool which installs the liner in the well bore. The seal assembly can be released by right hand rotation of the tubing string leading to the well surface, or be setting down weight on the tubing string, followed by a straight pull on the tubing string.

10 Claims, 12 Drawing Figures

LATCHING PRODUCTION SEAL ASSEMBLY

BACKGROUND OF THE INVENTION

1. Field of the Invention.

The present invention relates to seal assemblies of the type used to seal between a tubular well conduit and a surrounding conduit and, specifically, to a latching production seal assembly for sealing within the internal bore of a liner within a well.

2. Description of the Prior Art.

Oil and gas wells are completed by installing a production casing or "liner" into the hole from the surface and cementing the liner in place. The liner is typically provided with a setting sleeve having an internally threaded region which is engaged by the external threads of a conventional running tool. The running tool is used to lower the liner to the proper depth within the well, and to apply setting force to "hang" the liner from gripping members within the well bore.

After the liner has been hung and cemented in place, the liner is perforated at the producing depth and the oil and/or gas flows from the surrounding earthern formation through the perforations and up the liner to the surface, usually through production tubing.

In the past, production seal assemblies have generally included a latch mechanism with radially moving dogs which latched into a circumferential groove provided in a joint of the liner or extension thereof. The latch mechanism anchored the seal assembly in place and provided a sliding and sealing action which permitted the attached tubing string to lengthen or shorten due to pressure and temperature changes in the well bore during operation of the well.

The radially moving dogs utilized in prior latch mechanisms of the above type presented a possible problem area, since sand and other contaminates could impede the action of the dogs. In addition, the provision of a circumferential groove in the surrounding well conduit required additional milling and the presence of the specially designed pipe sub in the liner string which was to receive the seal assembly and latch mechanism.

The present invention has as its object the provision of a retrievable production seal assembly which can be latched into the internally threaded surface of the liner setting sleeve. These are the same threads which are engaged by the liner running tool during the installation of the liner within the well bore and prior to retreiving the running tool to the well surface.

Another object of the invention is the provision of a latch mechanism for latching into the liner setting sleeve threads which eliminates the need for radially moving dogs.

Another object of the invention is the provision of a seal assembly which allows a straight pull release as a safety measure in addition to a standard release effected by right hand rotation of the tubing string from the well surface.

SUMMARY OF THE INVENTION

The seal assembly of the invention is used to seal a tubing string within the internal bore of a liner, the liner being of the type which includes a liner setting sleeve with internal threads which are engaged by mating threads of a liner running tool during the installation of the liner within the well bore. The seal assembly includes a tubular mandrel having upper connecting means for connection to a tubing string leading to the well surface. The mandrel has an upper abutment and a spaced-apart lower abutment on the exterior thereof. A latch collet is carried about the mandrel between the upper and lower abutments. The latch collet has a collet body and a plurality of externally threaded collet fingers extending downwardly therefrom which are adapted to engage the setting sleeve threads.

A clutch sleeve is located between the mandrel and the latch collet. The clutch sleeve has a plurality of radially extending cogs which are adapted to be received between the fingers of the latch collet for transmitting torque between the clutch sleeve and the latch collet. The lower abutment is provided with cam means for engaging mating cam means on the clutch sleeve when the mandrel is lifted for rotating the clutch sleeve when the mandrel is rotated to unthread the latch collet from the setting sleeve threads.

A clutch collet is provided having a collet body with an externally threaded surface which is adapted to engage a mating internally threaded surface of the latch collet body. The clutch collet has a plurality of downwardly extending collet fingers which are received within a recess formed in an upper interior surface of the clutch sleeve. The clutch body is provided with cam means at the end thereof opposite the collet fingers. The cam means are engageable with a mating cam means formed on the upper abutment when weight is set down on the mandrel from the well surface, whereby rotation of the mandrel results in downward travel of the clutch collet threads relative to the latch collet threads and, in turn, downward axial travel of the clutch sleeve. The lower abutment normally contacts the latch collet fingers when the mandrel is lifted to prevent inward radial movement of the latch collet fingers. Downward axial travel of the clutch collet moves the lower abutment from beneath the latch collet fingers to allow inward radial movement of the latch collet fingers and retrieval of the tubular conduit to the well surface.

The mandrel also carries seal means thereon for sealingly engaging the internal bore of the setting sleeve above the setting sleeve threads and above the latch mechanism.

Additional objects, features and advantages will be apparent in the written description which follows.

DETAILED DESCRIPTION OF THE INVENTION

Figure 1A:
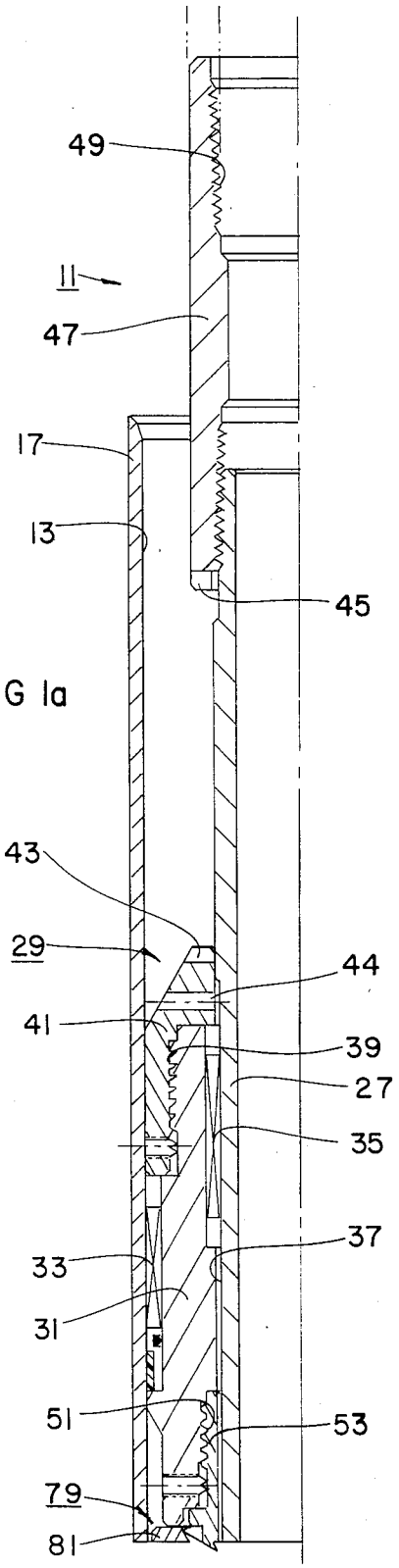
FIG. 1*a* is a side, partial cross-sectional view of the upper portion of the production seal assembly of the invention in the running-in position.
Figure 1B:
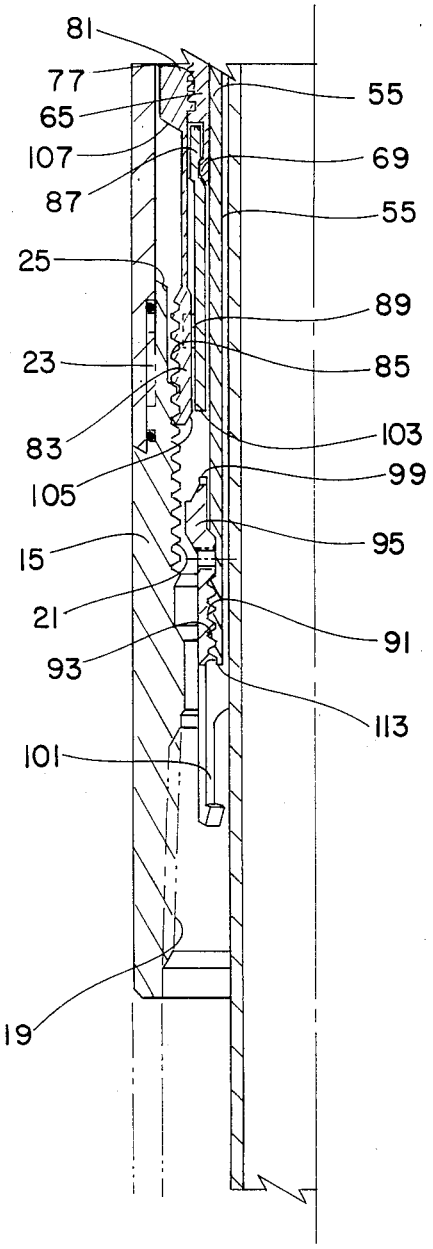
FIG. 1*b* is a downward continuation of the seal assembly of FIG. 1A.

FIGS. 1*a*–1*b* show a retrievable production seal assembly of the invention designated generally as 11. The seal assembly 11 is used for sealing within the internal bore 13 of a liner within a well. The liner is a cylindrical conduit of conventional design including a setting sleeve 15 and an upwardly extending setting sleeve extension 17. The liner has an internally threaded surface 19 for engaging the pin member (shown in dotted lines) of a mating liner string extending downwardly into the well. The setting sleeve 15 and setting sleeve extension 17 are joined at a threaded connection 23 to form an internal shoulder 25.

The liner setting sleeve 15 has an internally threaded surface 21 which is adapted to be engaged by the mating threads of a conventional liner running tool during the installation of the liner within the well bore, and prior to retrieving the running tool to the well surface. Liner running and setting tools of the type under discussion are known to those skilled in the art and do not form a part of the present invention. Such a liner running tool is shown, for instance, in U.S. Pat. No. 4,441,560, issued Apr. 10, 1984, to John L. Baugh, et al.

As shown in FIGS. 1*a*–1*b*, the seal assembly includes a tubular mandrel 27 having a seal means 29 carried thereon for sealingly engaging the internal bore 13 of the setting sleeve extension 17 above the setting sleeve threads 21. The seal means 29 includes a seal body 31 which has an external seal region, including packing 33, for sealing against the interior bore 13 of the liner setting sleeve extension 17 and has an internal seal region, including packing 35, for sealing against the exterior surface 37 of the mandrel 27. The seal body 31 has upper external threads 39 for engaging a mating internal surface of a nose ring 41. The nose ring 41 has a notched end which defines a cam region 43 which is adapted to matingly engage a cam region 45 provided on the mandrel box 47, as will be explained. A port 44 in the nose ring vents the cam region when the nose ring 41 engages the mandrel box 47. The mandrel box 47 has an internally threaded surface 49 for engaging the pin end of a pipe joint (shown in dotted lines in FIG. 1A) of the production tubing string leading to the well surface.

Figure 2A:
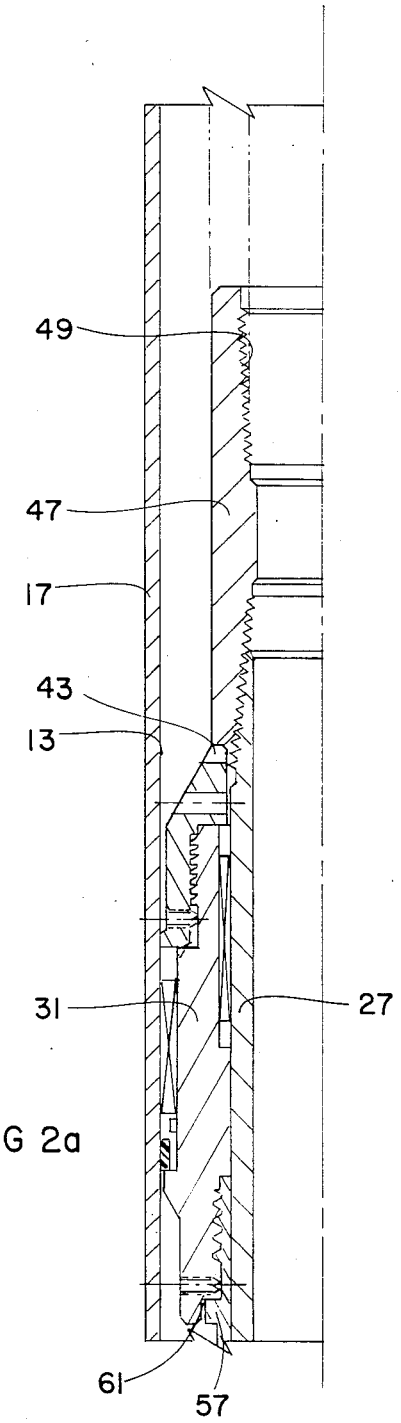
FIG. 2*a* is a side, partial cross-sectional view of the seal assembly of FIG. 1A.
Figure 6:
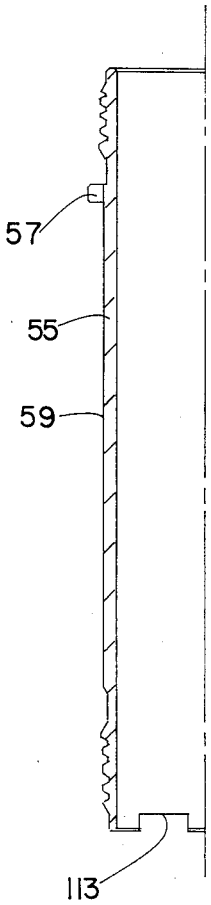
FIG. 6 is a side, cross-sectional view of the spacer sleeve used to space-apart the upper and lower abutments of the latch mechanism of the invention.

The seal body 31 also has a lower internally threaded surface 51 for engaging the upper end 53 of a spacer sleeve 55. The spacer sleeve 55 is shown in FIG. 6 and includes a camming cog 57 which protrudes from the external surface 59. Preferably, the sleeve 55 includes two cogs arranged at opposite circumferential locations about the external surface 59. As best seen in FIG. 2A, the cog 57 is received within a recess 61 at the lower end of the seal body 31 and is adapted to engage the upper camming surface 63 of a clutch collet 65 which is carried about the spacer sleeve 55.

Figure 4:
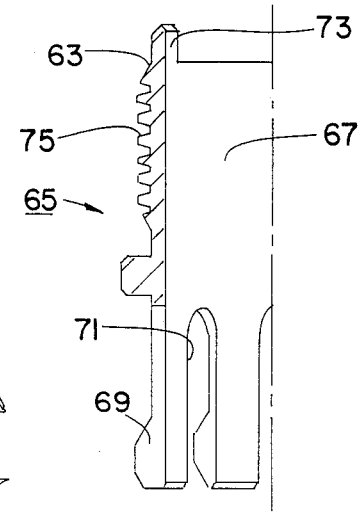
FIG. 4 is a side, partial cross-sectional view of the clutch collet of the latch mechanism of the invention.
Figure 3:
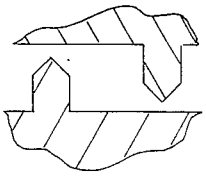
FIG. 3 is a simplified isometric view of the cam means of the lower abutment and clutch sleeve, showing the operation thereof.

The clutch collet 65 is shown in detail in FIG. 4. The clutch collet includes a collet body 67 and a plurality of downwardly extending collet fingers 69 which are separated by longitudinal openings 71. The upper camming surface 63 is made up of a plurality of upwardly extending projections 73 which matingly engage and mesh in the spaces provided between the camming cogs 57 of the seal body 31. The collet body 67 has an externally threaded surface 75 which is adapted to engage a mating internally threaded surface 77 of a latch collet 79.

The latch collet 79 includes a ring-shaped collet body 81 and a plurality of externally threaded collet fingers 83 extending downwardly therefrom. The externally threaded surfaces 85 are adapted to engage the liner setting sleeve threads 21 when the latch collet 81 is stabbed into the setting sleeve 15 as shown in FIG. 1B.

A clutch sleeve 87 depends downwardly from the clutch collet 65 and is located between the spacer sleeve 55 and the latch collet fingers 83, as shown in FIG. 1B. The clutch collet fingers 69 are engaged within a recess, or groove, formed in an upper interior surface of the clutch sleeve 87. The clutch sleeve 87 also includes a plurality of radially extending cogs 89 which are received within the longitudinal openings which exist between the collet fingers 83 of the latch collet 79 for transmitting torque from the clutch sleeve to the latch collet 79 to unthread the threaded surface 85 from the setting sleeve threads 21, as will be explained.

Figure 5:
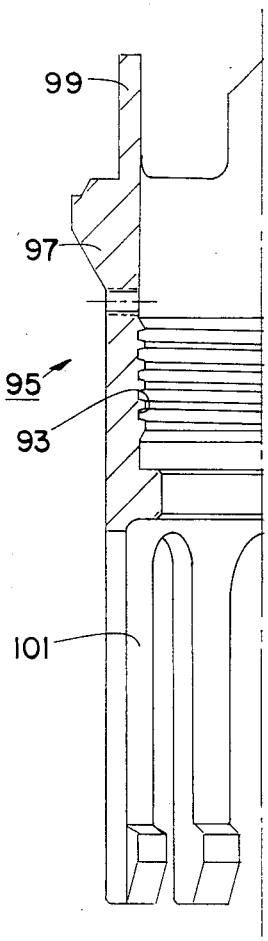
FIG. 5 is a side, partial cross-sectional view of the lower abutment and cam means of the latch mechanism of the invention.

The spacer sleeve 55 has an externally threaded end 91 which engages an internally threaded surface 93 of a lower abutment 95. As shown in FIG. 5, the lower abutment 95 can be provided as a collet-like member having an upper collet body 97 with a plurality of axially extending projections 99 and a plurality of downwardly extending collet fingers 101. The projections 99 act as cam means for engaging mating cam recesses provided in the lower end 103 of the clutch sleeve 87, in the same way that the projections 73 of the clutch collet 67 engage the cogs 57 of the spacer sleeve.

The operation of the seal assembly and latch mechanism of the invention will now be described. The liner is first run into position in the well bore by means of a running tool, such as that shown in U.S. Pat. No. 4,441,560, which engages the threaded surface 21 of the liner setting sleeve. The liner is hung at the proper depth by appropriate manipulation of the running tool to actuate external gripping means (not shown) on the liner hanger. The liner is then typically cemented in place, and the running tool is retrieved to the well surface. All of these steps are conventional practice and are known to those skilled in the art.

When it is desired to produce from the well, or if it is necessary to perform workover operations, the retrievable seal assembly is run into position. In the running-in position shown in FIGS. 1*a* and 1*b*, the seal body 31 and external seal region 33 slide along the internally bore 13 of the setting sleeve extension 17. The metal bore 13 can be "polished" to provide a smooth surface. As the latch collet fingers 83 contact the internal threaded surface 21 of the liner setting sleeve 15, the latch assembly including the latch collet 79 engages the seal body 31. The lower abutment 95 is moved axially downwardly from beneath the lower tapered surfaces 105 of the latch collet fingers, thereby allowing the latch collet fingers to ratchet or "stab" into and matingly engage the setting sleeve threads 21.

Downward axial movement of the latch collet fingers 83 allows the external taper 107 of the latch collet body 81 to contact the shoulder 25 provided by the liner setting sleeve. When this occurs, further downward travel of the latch collet 79 is prevented.

Figure 2B:
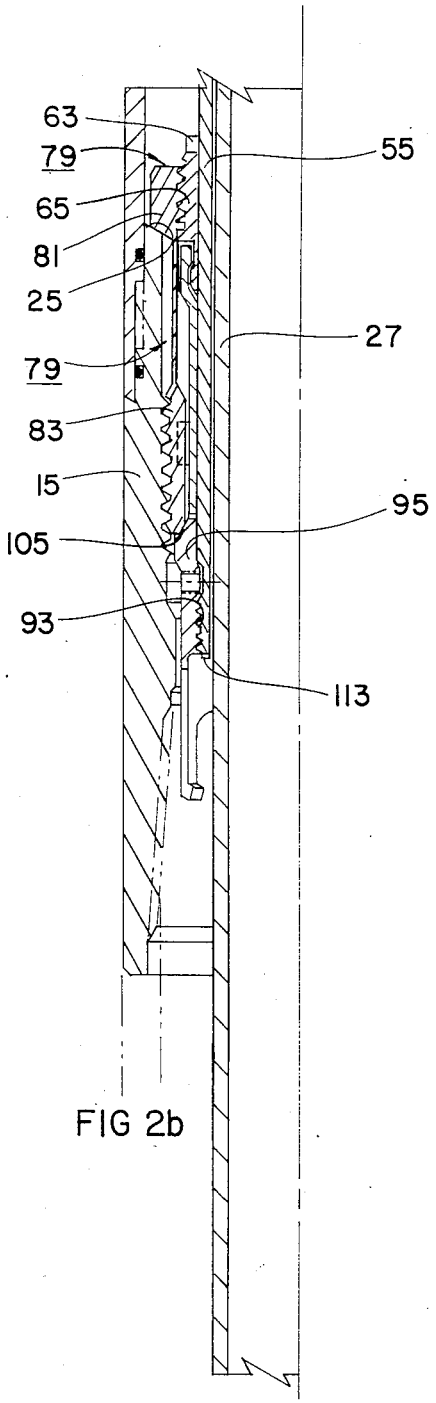
FIG. 2*b* is a downward continuation of FIG. 2A, showing the seal assembly latched into position within the liner setting sleeve in the producing position.

In the producing position shown in FIGS. 2a–2b, any force tending to push the mandrel 27 and tubing string upwardly out of the well bore acts to push the lower abutment 95 into tighter engagement with the collet fingers 83 and more securely engage the latch mechanism within the thread profile of the liner setting sleeve 15. Downward movement of the latch mechanism is restrained by contact between the latch collet external taper 107 and the shoulder 25 of the liner setting sleeve. The mandrel 27, which is shown broken in FIG. 2a, can extend 20 to 30 feet or more in length. As a result, the mandrel 27 is allowed a "stroke" without disturbing the seal and without disengaging the latch mechanism from within the setting sleeve.

The latch mechanism is normally released by lifting upwardly on the tubing string and mandrel 27 from the well surface. This action causes the axially extending projections 99 of the lower abutment 95 to engage the cam recesses 103 provided in the lower end of the clutch sleeve 87 (FIG. 1b). This action also causes cam projections 109 of the mandrel lower box 111 to engage mating cam profiles 113 (FIG. 6 and 9b) provided in the spacer sleeve 55. As a result, torque transmitted to the mandrel 27 by rotating the tubing sleeve from the surface is transmitted through the box 111 and cam surfaces 109, 113 to the spacer sleeve 55. Torque transmitted to the spacer sleeve 55 is transmitted through the threaded connection 93 (FIG. 2b) to the lower abutment 95 and through the cams 99, 103 to the clutch sleeve 87. The torque is then transmitted through the clutch sleeve cogs 89 to the latch collet fingers 83. The setting sleeve threads 21 (FIG. 1b) are preferably left hand threads so that right hand torque on the tubing string from the well surface unthreads the latch collet fingers, allowing the seal assembly to be retrieved upwardly from the well bore.

Figure 7:
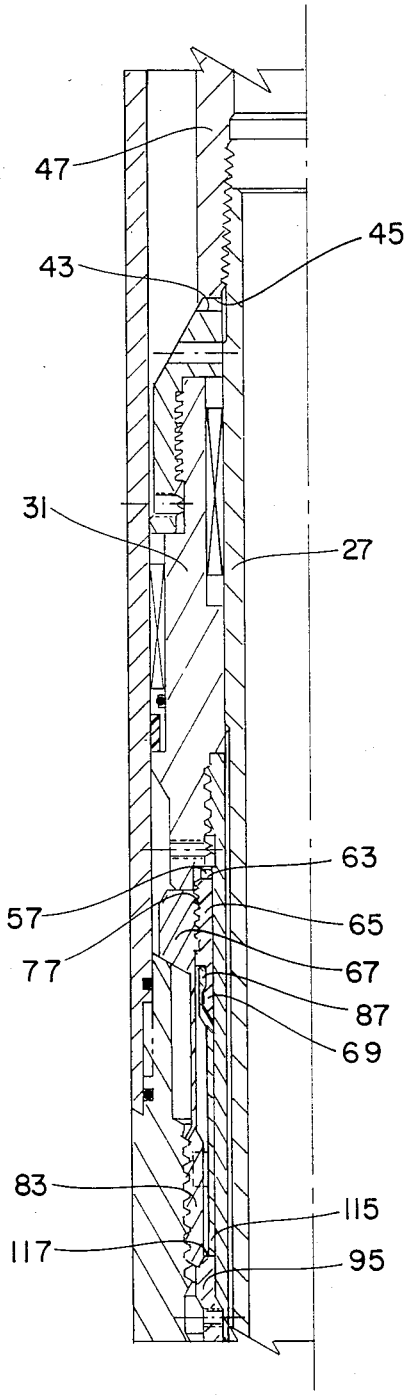
FIG. 7 is a side, partial cross-sectional view of the upper portion of the seal assemby of the invention with weight set down on the tubing string from the well surface.
Figure 8:
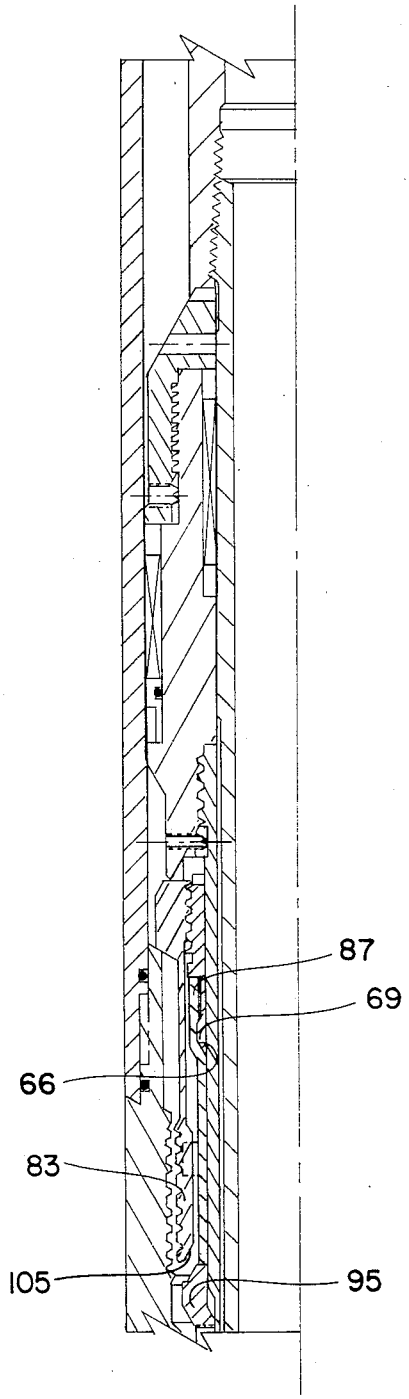
FIG. 8 is a side, partial cross-sectional view similar to FIG. 7 showing the safety release feature of the latch mechanism.

In the event that the operator encounters difficulty in disengaging the latch mechanism as previously described, an additional safety release is provided. In order to effect the safety release, weight is set down on the tubing string from the well surface causing the seal body 31 and cam 57 to engage the upper camming surface 63 of the clutch collet 65, as shown in FIG. 7. The cam regions 43, 45 of the seal body 31 and mandrel box 47 are also engaged. Torque applied to the tubing string from the well surface now acts through the cam 43, 45 to rotate the seal body 31. Because the cams 57, 63 are also engaged, the clutch collet 65 is rotated and travels approximately ⅜ inch down the threaded surface 77 of the latch collet body 67. Since the collet fingers 69 of the clutch collet 65 are received within a circumferential groove 66 (FIG. 8) provided in the upper end of the clutch sleeve 87, the rotational movement of the clutch collet 65 is translated into downward axial travel of the clutch sleeve 87.

Figure 9A:
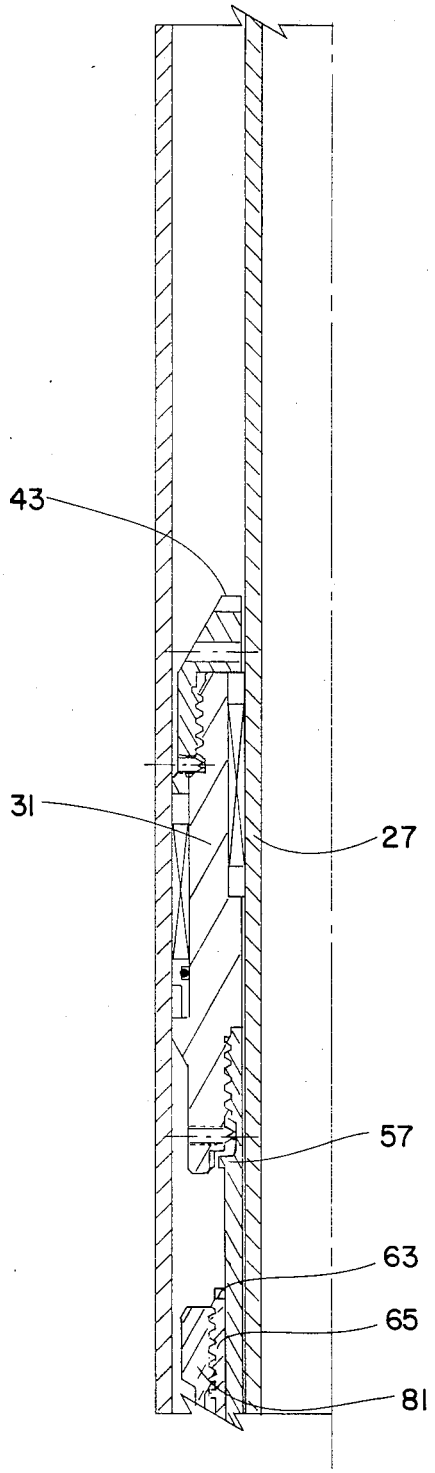
FIG. 9*a* is a side, partial cross-sectional view of the seal assembly being retrieved to the well surface.
Figure 9B:
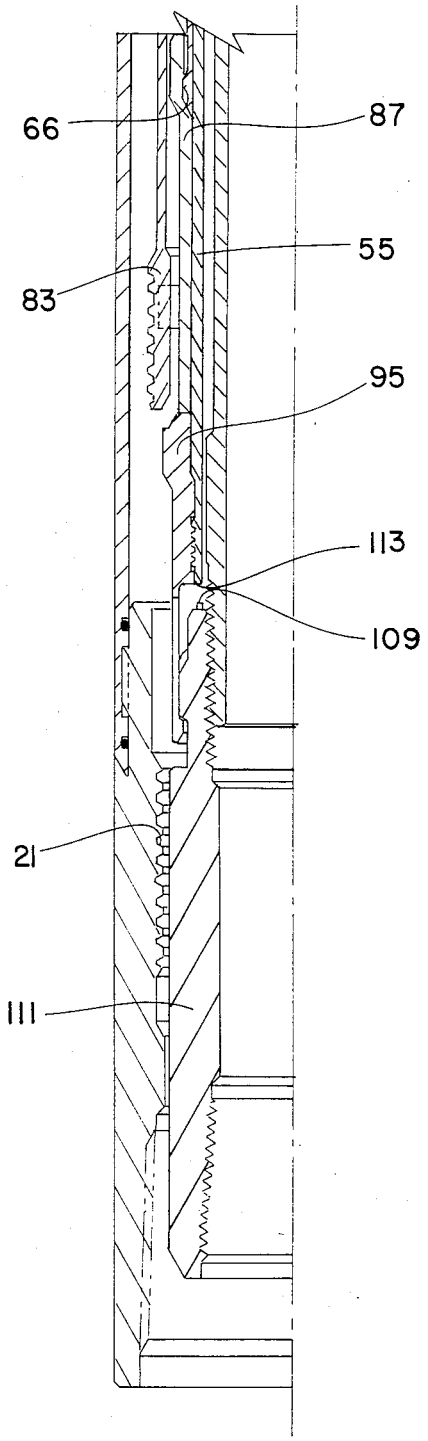
FIG. 9*b* is a downward continuation of the seal assembly of FIG. 9*a*.

As shown in FIG. 7, the lower end 115 of the clutch sleeve 87 normally engages the upper surface 117 of the lower abutment 95 in the position shown. Downward axial travel of the clutch sleeve 87 moves the lower abutment 95 from beneath the lower tapered surface 105 of the collet fingers 83, allowing the collet fingers to spring radially inwardly to release the latch mechanism as the latch mechanism and seal assembly are pulled upwardly from the well bore. As shown in FIGS. 9a and 9b, the position of the clutch sleeve 87 prevents the lower abutment 95 from reengaging the latch collet fingers 83 as the latch collet is being pulled from the liner setting sleeve threads 21.

An invention has been provided with several advantages. The retrievable production seal assembly of the invention uses a unique latch mechanism which allows the device to be latched into the running tool threads of the liner setting sleeve. As a result, a specially machined sub with a circumferential groove for receiving radially moving dogs is not needed. The stab-in operation of the latch collet is more reliable than radially moving dogs. The seal assembly is normally released by picking up on the tubing string which engaging mating camming surfaces on the mandrel, lower abutment and clutch sleeve, allowing rotational torque to be transmitted through the mandrel to the latch collet for unthreading the latch collet. If for some reason rotation cannot be achieved through the latch collet, a safety release is provided. After rotating the clutch collet only ⅜ inch, the safety release allows the device to be retrieved to the well surface by a straight pull on the tubing string and mandrel.

While the invention has been shown in only one of its forms, it is not thus limited but is susceptible to various changes and modifications without departing from the spirit thereof.

I claim:

1. A retrievable production seal assembly for sealing within the internal bore of a liner within a well, the liner being of the type which includes a liner setting sleeve with internal threads which are engaged by mating threads of a liner running tool during the installation of the liner within the well bore, the running tool being subsequently retrieved to the well surface prior to inserting the seal assembly, the seal assembly comprising:

a mandrel having an exterior with seal means carried thereon for sealingly engaging the internal bore of the setting sleeve above the setting sleeve threads, the seal means including an external seal region for sealing against the interior of the liner setting sleeve and an internal seal region for sealing against the exterior of the mandrel;

a latch collet carried about the mandrel below the seal means between an upper shoulder and a lower shoulder, the latch collet having a collet body and a plurality of externally threaded collet fingers extending downwardly therefrom which are adapted to engage the setting sleeve threads to secure the seal assembly within the liner; and a clutch sleeve located between the mandrel and the latch collet, the clutch sleeve having a plurality of radially extending cogs which are adapted to be received between the fingers of the latch collet for transmitting torque between the clutch sleeve and the latch collet.

2. A retrievable production seal assembly for sealing within the internal bore of a liner within a well, the liner being of the type which includes a liner setting sleeve with internal threads which are engaged by mating threads of a liner running tool during the installation of the liner within the well bore, the running tool being subsequently retrieved to the well surface prior to inserting the seal assembly, the seal assembly comprising:

a mandrel having an exterior with a seal member carried thereon for sealingly engaging the internal bore of the setting sleeve above the setting sleeve threads, the seal member including an external seal region for sealing against the interior of the liner setting sleeve and an internal seal region for the sealing against the exterior of the mandrel;

a support sleeve which surrounds the mandrel and connects the seal member with a spaced-apart, lower abutment;

a latch collet carried about the support sleeve between a shoulder on the seal member and a shoulder on the lower abutment, the latch collect having a collet body and a plurality of externally threaded collet fingers extending downwardly therefrom which are adapted to stab into and engage the setting sleeve threads to secure the seal assembly within the liner;

a clutch sleeve located between the support sleeve and the latch collet, the clutch sleeve having a plurality of radially extending cogs which are adapted to be received between the fingers of the latch collet for transmitting torque between the clutch sleeve and the latch collet; and wherein the mandrel is provided with cam means located below the lower abutment for engaging the lower abutment when the mandrel is lifted for rotating the lower abutment when the mandrel is rotated, and wherein the lower abutment also is provided with cam means for engaging the clutch sleeve for transmitting torque from the lower abutment to the clutch sleeve and from the clutch sleeve to the latch collet for unthreading the latch collet.

3. The retrievable production seal assembly of claim 2, further comprising:

a clutch collet having a collet body with an externally threaded surface adapted to engage a mating internally threaded surface of the latch collet body, the clutch collet having a plurality of downwardly extending collet fingers which are received within a recess formed in an upper interior surface of the clutch sleeve; and wherein the clutch collet body is provided with cam means at the end thereof opposite the collet fingers, the cam means being engageable with a mating cam formed by the seal member shoulder when weight is set down on the mandrel from the well surface and wherein the mandrel is provided with cam means engageable wih a mating cam on the opposite end of the seal member whereby rotation of the mandrel results in downward travel of the clutch collet threads relative to the latch collet threads and, in turn, downward axial travel of the clutch sleeve.

4. The retrievable seal assembly of claim 3, wherein the shoulder of the lower abutment normally contacts the latch collet fingers when the mandrel is lifted to prevent inward radial movement of the latch collet fingers, and wherein the downward axial travel of the clutch sleeve caused by rotation of the clutch collet moves the shoulder of the lower abutment from beneath the latch collet fingers to allow inward radial movement of the latch collet fingers to allow inward radial movement of the latch collet fingers and retrieval of the seal assembly to the well surface.

5. A method of engaging a seal assembly within the internal bore of a liner within a well, the liner being of the type which includes a liner setting sleeve with internal threads which are engaged by mating threads of a liner running tool during the installation of the liner within the well bore, the running tool being subsequently retrieved to the well surface prior to inserting the seal assembly, comprising the steps of:

making up a seal assembly as a part of a tubing string, the seal assembly including a mandrel with upper connecting means for connecting the mandrel within the tubing string and a seal member carried on the mandrel, the seal member including an external seal region for sealing against the interior of the liner setting sleeve and an internal seal region for sealing against the exterior of the mandrel;

installing a latch collet about the mandrel below the seal member, the latch collet having a collet body and a plurality of externally threaded collet fingers extending downwardly therefrom;

engaging the seal assembly within the internal bore of the liner by running the seal assembly into the bore of the liner and stabbing the externally threaded collet fingers into the internal threads of the setting sleeve;

providing cam means engageable between the mandrel and the latch collet for transmitting torque from the mandrel to the latch collet when the tubing string is rotated from the well surface;

lifting the tubing string from the well surface to engage the cam means; and rotating the tubing string to the right to unthread the latch collet fingers from the internal threads of the setting sleeve to release the seal assembly.

6. A method of engaging a seal assembly within the internal bore of a liner within a well, the liner being of the type which includes a liner setting sleeve with internal threads which are engaged by mating threads of a liner running tool during the installation of the liner within the well bore, the running tool being subsequently retrieved to the well surface prior to inserting the seal assembly, comprising the steps of:

making up a seal assembly as a part of a tubing string, the seal assembly including a mandrel with upper connecting means for connecting the mandrel within the tubing string and a seal member carried on the mandrel, the seal member including an external seal region for sealing against the interior of the liner setting sleeve and an internal seal region for sealing against the exterior of the mandrel;

installing a latch collet about the mandrel below the seal member, the latch collet having a collet body and a plurality of externally threaded collet fingers extending downwardly therefrom;

engaging the seal assembly within the internal bore of the liner by running the seal assembly into the bore of the liner and stabbing the externally threaded collet fingers into the internal threads of the setting sleeve;

providing cam means engageable between the mandrel and the latch collet for transmitting torque from the mandrel to the latch collet when the tubing string is rotated from the well surface;

lifting the tubing string from the well surface to engage the cam means;

rotating the tubing string to the right to unthread the latch collet fingers from the internal threads of the setting sleeve to release the seal assembly;

providing a lower abutment which is carried about the mandrel below the latch collet which is normally engageable with the latch collet fingers as the mandrel moves upwardly to prevent inward radial movement of the latch collet fingers;

providing additional cam means between the mandrel and the seal member and between the seal member and a clutch means, the cam means serving to transmit torque from the mandrel to the seal member and from the seal member to the clutch means when weight has been set down on the tubing string from the well surface, the clutch means serving to displace the lower abutment from beneath the collet fingers when the tubing string is lifted from the well surface to thereby allow the latch collet threads to be disengaged from the setting sleeve threads;

setting weight down on the tubing string to engage the additional cam means and the clutch means;

rotating the tubing string from the well surface to displace the lower abutment; and lifting the tubing string from the well surface to pull the latch collet fingers out of the setting sleeve internal threads.

7. A latch mechanism of the type used to engage a tubular conduit within the internal bore of a liner within a well, the liner being of the type which includes a liner setting sleeve with internal threads which are engaged by mating threads of a liner running tool during the installation of the liner within the well bore, the running tool being subsequently retrieved to the well surface prior to inserting the seal assembly, the latch mechanism comprising:

a tubular mandrel having upper and lower connecting means for connection to a tubular conduit leading to the well surface, the mandrel having an upper abutment and a spaced-apart lower abutment on the exterior thereof;

a latch collet carried about the mandrel between the upper and lower abutments, the latch collet having a collet body and a plurality of externally threaded collet fingers extending downwardly therefrom which are adapted to engage the setting sleeve threads;

a clutch sleeve located between the mandrel and the latch collet, the clutch sleeve having a plurality of radially extending cogs which are adapted to be received between the fingers of the latch collet for transmitting torque between the clutch sleeve and the latch collet; and wherein the lower abutment is provided with cam means for engaging mating cam means on the clutch sleeve when the mandrel is lifted for rotating the clutch sleeve when the mandrel is rotated to unthread the latch collet from the setting sleeve threads.

8. A latch mechanism of the type used to engage a tubular conduit within the internal bore of a liner within a well, the liner being of the type which includes a liner setting sleeve with internal threads which are engaged by mating threads of a liner running tool during the installation of the liner within the well bore, the running tool being subsequently retrieved to the well surface prior to inserting the seal assembly, the latch mechanism comprising:

a tubular mandrel having upper and lower connecting means for connection to a tubular conduit leading to the well surface, the mandrel having an upper abutment and a spaced- apart lower abutment on the exterior thereof;

a latch collet carried about the mandrel between the upper and lower abutments, the latch collet having a collet body and a plurality of externally threaded collet fingers extending downwardly therefrom which are adapted to engage the setting sleeve threads;

a clutch sleeve located between the mandrel and the latch collet, the clutch sleeve having a plurality of radially extending cogs which are adapted to be received between the fingers of the latch collet for transmitting torque between the clutch sleeve and the latch collet, the lower abutment being provided with cam means for engaging mating means on the clutch sleeve when the mandrel is lifted for rotating the clutch sleeve when the mandrel is rotated to unthread the latch collet from the setting sleeve threads; and a clutch collet having a collet body with an externally threaded surface adapted to engage a mating internally threaded surface of the latch collet body, the clutch collet having a plurality of downwardly extending collet fingers which are received within a recess formed in an upper interior surface of the clutch sleeve.

9. The latch mechanism of claim 8, wherein the clutch body is provided with cam means at the end thereof opposite the collet fingers, the cam means being engageable with a mating cam means formed on the upper abutment when weight is set down on the mandrel from the well surface, whereby rotation of the mandrel results in downward travel of the clutch collet threads relative to the latch collet threads and, in turn, downward axial travel of the clutch sleeve.

10. The latch mechanism of claim 9, wherein the lower abutment normally contacts the latch collet fingers when the mandrel is lifted to prevent inward radial movement of the latch collet fingers, and wherein the downward axial travel of the clutch collet moves the lower abutment from beneath the latch collet fingers to allow inward radial movement of the latch collet fingers and retrieval of the tubular conduit to the well surface.

* * * * *